US008104985B2

(12) United States Patent
Manici et al.

(10) Patent No.: US 8,104,985 B2
(45) Date of Patent: Jan. 31, 2012

(54) APPLICATOR DISPENSER FOR A COSMETIC PRODUCT

(75) Inventors: Davide Manici, Beverate di Brivio (IT); Paolo Giusti, Saronno (IT)

(73) Assignee: Benson S.R.L. (IT)

( * ) Notice: Subject to any disclaimer, the term of this patent is extended or adjusted under 35 U.S.C. 154(b) by 1387 days.

(21) Appl. No.: 11/535,591

(22) Filed: Sep. 27, 2006
(Under 37 CFR 1.47)

(65) Prior Publication Data

US 2007/0223987 A1 Sep. 27, 2007

(30) Foreign Application Priority Data

Sep. 27, 2005 (FR) ..... 05 09855

(51) Int. Cl.
*A46B 17/08* (2006.01)

(52) U.S. Cl. ..... 401/122

(58) Field of Classification Search ..... 401/121, 401/122, 126, 127, 129
See application file for complete search history.

(56) References Cited

U.S. PATENT DOCUMENTS

| | | | | |
|---|---|---|---|---|
| 4,927,281 | A | 5/1990 | Gueret | |
| 6,067,997 | A | 5/2000 | Gueret | |
| 6,568,405 | B2 * | 5/2003 | Masuyama | 132/218 |
| 7,182,535 | B2 * | 2/2007 | Lim | 401/129 |
| 7,455,468 | B2 * | 11/2008 | Gueret | 401/126 |

FOREIGN PATENT DOCUMENTS

| | | | |
|---|---|---|---|
| EP | 1177741 | A1 | 2/2002 |
| FR | 2627068 | A | 8/1989 |
| FR | 2762494 | A | 10/1998 |
| GB | 1215762 | | 12/1970 |

* cited by examiner

*Primary Examiner* — Huyen Le
(74) *Attorney, Agent, or Firm* — Banner & Witcoff, Ltd.

(57) ABSTRACT

An applicator dispenser has a container defining a tank with a lateral wall and a neck integral with a wiper. An applicator includes a cap having an outer shell and a threaded insert, and an axial wand fixedly attached to the insert and to an application means. The lateral wall of the tank forms at its upper part a straight skirt. The container has a closure component having an upper part forming the neck, a peripheral part engaging in a sealed way with the straight skirt, and a lower part engaging with the wiper forming a forward axial stop for the wiper. The wiper has a central part forming a swaged wiping part and a lateral part engaging with the lower part of the closure component.

8 Claims, 14 Drawing Sheets

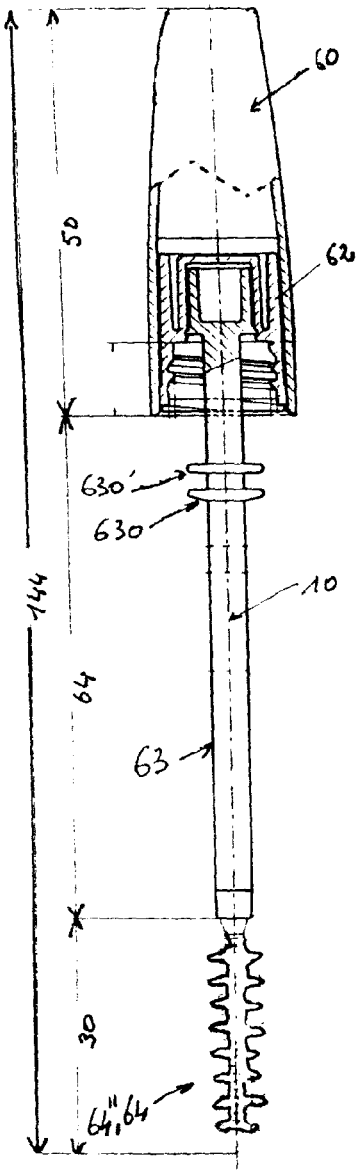
FIG. 1e
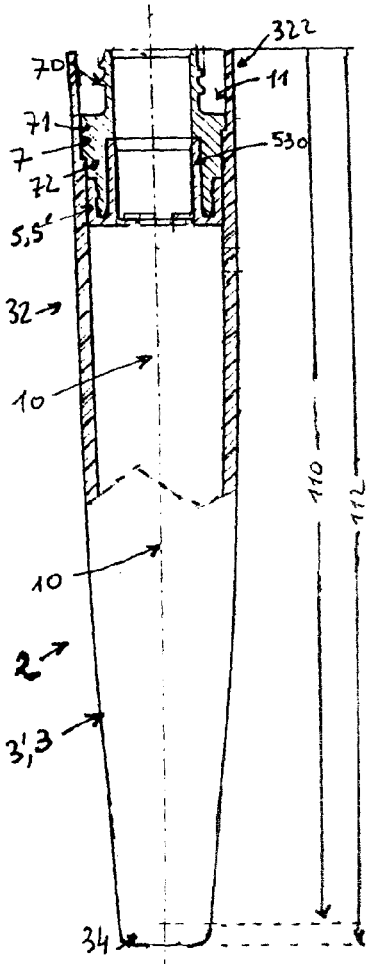
FIG. 1d
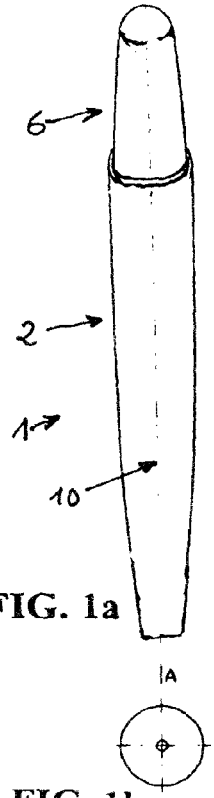
FIG. 1a
FIG. 1b
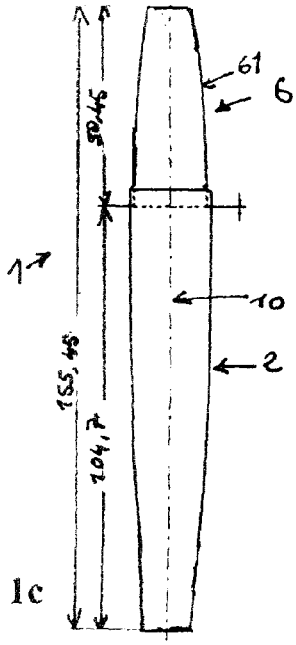
FIG. 1c

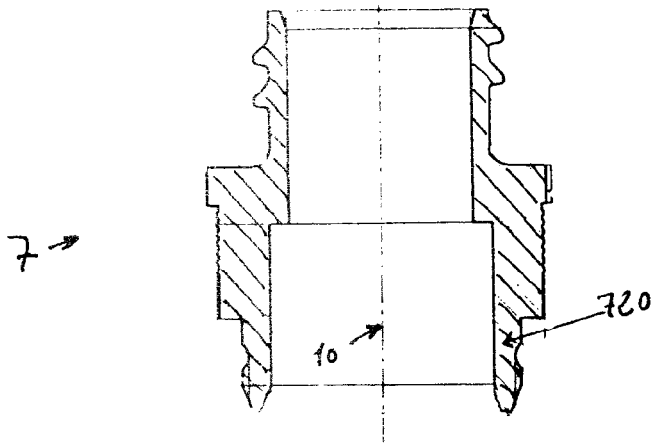
FIG. 4a
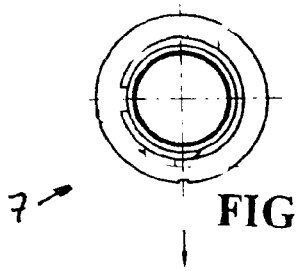
FIG. 4d
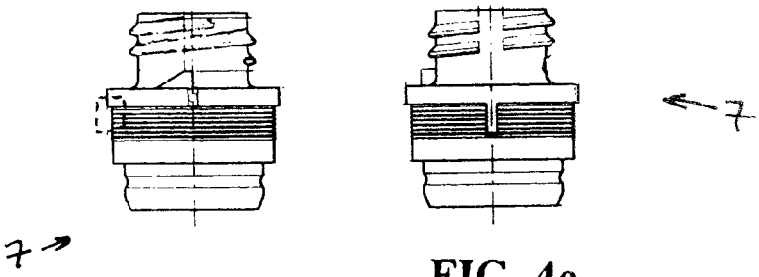
FIG. 4c
FIG. 4b
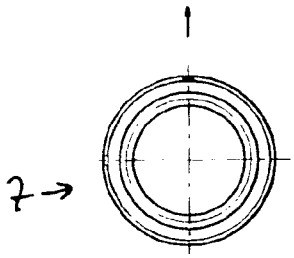
FIG. 4e
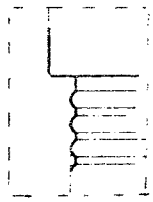
FIG. 4f

APPLICATOR DISPENSER FOR A COSMETIC PRODUCT

BACKGROUND

Applicators for dispensing cosmetic products, such as mascara, typically have a container with a threaded neck fitted with a wiper. An applicator having an axial wand is fitted at one end with a threaded cap and at the other end with an application means, typically a brush. The threaded cap engages the neck to seal the tank. The wiper has a diameter selected to allow the wand to pass and to wring the application means, e.g., the brush loaded with product for application when the applicator is removed from the tank.

Typically, the tank is a plastic component generally formed by molding. The wiper typically is a separate component, often made of elastomer, which can be snapped into the neck. The applicator is generally formed by assembling at least three components: a component forming an outer cap, a component cast in a single piece of plastic having a wand fitted at one end with an insert or part that can be snapped into the outer cap, and an application means, e.g., a brush, fitted to the other end of the wand.

The wiper is a component, sometimes an independent component, which is much acted upon in the axial direction when the applicator is removed from the tank for the purpose of applying the product contained in its tank. When the applicator is withdrawn, the application means exerts an axial pressure which tends to separate the wiper from the rest of the tank. This problem can be exasperated when some of the product gets deposited in and possibly dried around the central orifice of the wiper or in this orifice.

Furthermore, over time, the viscosity of the product tends to increase, which increases the frictional drag exerted by the application means on the wiper. As a result, the risk of the wiper being torn out and dragged along by the applicator is increased.

Given the variety of products to be packaged, it may be necessary to have specific application means adapted to particular products, in the same way that it may be necessary to use different application means to obtain certain particular makeup effects. But whatever the reason for modifying the application means, it is generally necessary to give the wiper a geometry adapted to the application means. In many cases, this may make it impossible to mold a wiper when it does not constitute an independent component, particularly relative to the neck.

Furthermore, in many prior art applicator dispensers, the tank and the neck form a molded component cast in a single piece, with the tank having a skirt added to the neck via an inner shoulder in such a way that, particularly for aesthetic reasons, the cap and the tank have one and the same outer cross-section. The product filling operation is long and impractical, particularly with mascara, insofar as a relatively viscous product has to pass through a relatively narrow neck. For commercial reasons, it is important for the product to be regularly renewed.

Examples of applicator dispensers are shown in the following French patents, and more particularly in the figures indicated: FR 2 850 549 (FIG. 1), FR 2 796 532 (FIG. 1), FR 2 796 530 (FIG. 1), FR 2 779 041 (FIG. 1), FR 2 771 907 (FIG. 1B), FR 2 762 494 (FIG. 9), FR 2 745 481 (FIG. 9), FR 2 648 686 (FIGS. 1 and 2) and FR 2 627 068 (FIG. 1).

BRIEF SUMMARY

In one aspect, an applicator dispenser for a cosmetic product, such as mascara, has an axial direction and includes a container. The container has a neck which is typically threaded on the outside. A longitudinal tank is fitted with a lateral wall and forms a cavity for the packaging the cosmetic product. The neck can be integral with a wiper of the application means having a swaged wiping part delimiting a central orifice. An applicator for the cosmetic product includes a cap which can grip the applicator. The cap typically has an outer shell and an insert threaded internally so as to engage with the neck by screwing to provide a sealed closure of the container. An axial wand can be fixedly attached by its upper end to the insert and by its lower end to an application means. The application means can be physically immersed into the product when the head is screwed onto the neck for the purpose of taking out a fraction of the product for use.

The lateral wall of the tank forms or comprises at its upper part a straight, typically annular, skirt, open at its upper end. An upper opening of transverse cross-section SR can range from about 50 $mm^2$ to about 150 $mm^2$. The container has a component for closing the opening integral with the tank. The closure component, which is typically a molded component distinct from the tank, includes a upper part forming the neck, a peripheral part engaging in a sealed way with the straight skirt of the tank via an axial assembly, and a lower part engaging with the wiper forming a forward axial stop for the wiper. The wiper can be formed as a molded component distinct from the closure component. The wiper includes a central part forming the swaged part and a lateral part engaging with the lower part of the closure component by a secondary assembly, so as to form an assembly component.

This applicator dispenser configuration helps to ensure that the wiper is fixedly attached to the closure component by engagement of its central part with the lower part of the closure component. The wiper may have a central part adapted to any type of application means so as to wring the application means. The central part may be adapted to any shape or any type of application means.

The applicator dispenser also has a tank having an opening of relatively high transverse cross section, which facilitates the operation of filling the tank with the cosmetic product. The applicator dispenser makes it possible to obtain, apart from technically advantageous functions, a variety of new shapes.

BRIEF DESCRIPTION OF THE DRAWINGS

The features, and advantages of the invention will be apparent from the following more detailed description of certain embodiments of the invention and as illustrated in the accompanying drawings in which:

FIGS. 1*a* to 5*e* relate to an applicator dispenser (1) embodiment according to one embodiment of the invention.

FIG. 1*a* is a side perspective view of the closed applicator dispenser (1), the applicator (6) being screwed onto the tank (2).

FIG. 1*b* is a view from underneath of the applicator dispenser (1) in FIG. 1*a*.

FIG. 1*c* is a side view of the applicator dispenser (1) in FIG. 1*a*.

FIG. 1*d* is a view in axial cross-section (upper part), along the axial direction (10), of the container (2) of the applicator dispenser (1) in FIGS. 1*a* and 1*c*.

FIG. 1*e* is a view in axial cross-section along the axial direction (10) of the applicator (6) of the applicator dispenser (1) in FIGS. 1*a* and 1*c*.

FIG. 2*a* is a view in axial cross-section along the axial direction (10).

FIG. 2*b* is a perspective view from above.

FIG. 2*c* is an enlarged view of the part of FIG. 2*a* surrounded by a dotted rectangle (reference c).

FIG. 3*a* is a view of the axial wand (63) in axial cross-section (upper part) comprising at its upper part a head (632) for assembly with the insert (62) and at its lower part, a means of anchoring the application means in the form of a blind hole (631). The wand (63) comprises radial annular projections (630, 630') intended to seal the closure of the neck.

FIGS. 3*b* to 3*d* relate to the outer shell (61).

FIG. 3*b* is an axial cross-section.

FIG. 3*c* is a side perspective view.

FIG. 3*d* is a view from underneath.

FIG. 3*e* is an enlarged view of the lower part of FIG. 3*a*.

FIG. 3*f* is a view in axial cross-section of the insert (62).

FIGS. 4*a* to 4*f* relate to the closure component (7).

FIG. 4*a* is an axial cross-section.

FIG. 4*b* is a side view.

FIG. 4*c* is another side view 90° from the previous one.

FIG. 4*d* is a view from above of the closure component (7) in FIG. 4*b*.

FIG. 4*e* is a view from underneath of the closure component (7) in FIG. 4*b*.

FIG. 4*f* is an enlarged view of the part in FIG. 4*b* surrounded by a dotted rectangle.

FIGS. 5*a* to 5*e* illustrate the wiper (5, 5') shown in FIG. 1*d*.

FIG. 5*a* is a view of an axial cross-section of the wiper (5, 5').

FIG. 5*b* is a side view of the wiper in FIG. 5*a*.

FIG. 5*c* is a view from underneath of the wiper in FIG. 5*b*.

FIG. 5*d* is an enlarged view of FIG. 5*c*.

FIG. 5*e* is an enlarged view of the part of FIG. 5*a* surrounded by a dotted rectangle.

FIGS. 8*a* to 11*b* show the secondary assembly of the closure component (7) and the wiper (5) for constituting the assembly component (8).

In FIG. 8*a*, the lateral part (53) of the wiper (5) comprises an outer axial projection (531) which engages with the lower part (72) of the closure component by a snap-on means (82) formed by male and female part engagement.

FIG. 11*b* shows a view from underneath of the wiper (5) in FIG. 11*a*.

FIG. 12*a* shows the molded tank (3') with an arrow representing the filling thereof.

FIG. 12*b* shows the closure unit (9) comprising the assembly component (8) fixedly attached by screwing to the applicator (6).

FIG. 12*c* shows the applicator dispenser (1) obtained after closing the tank (3, 3') by axially snapping on the closure unit (9).

DETAILED DESCRIPTION

Figure 2A:
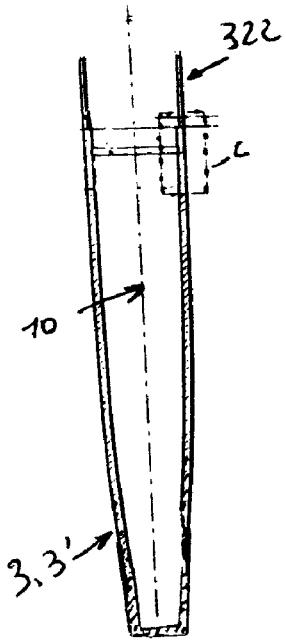
FIGS. 2*a* to 2*c* are alternative views of the tank (3) shown in FIG. 1*d*.
Figure 2B:
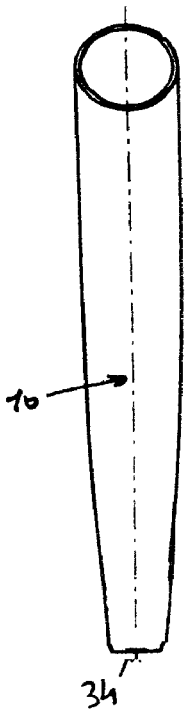
Figure 2C:
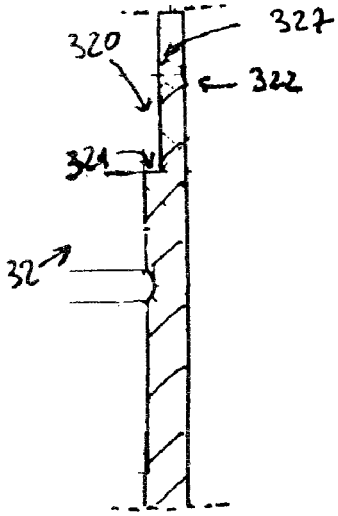
Figure 3A:
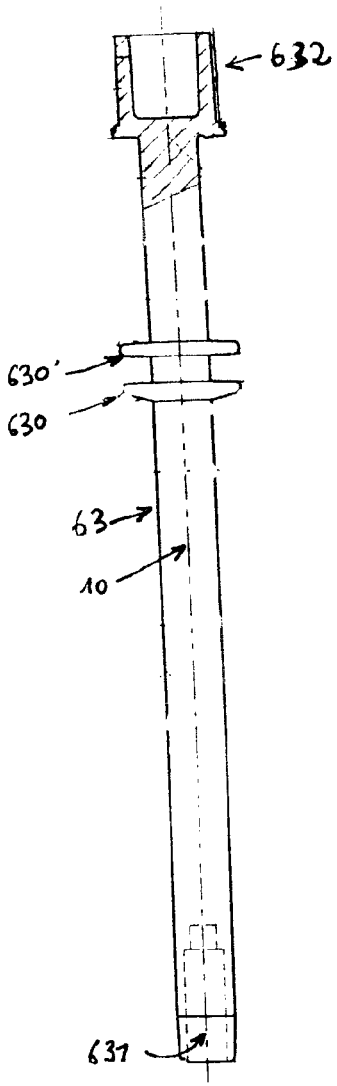
FIGS. 3*a* to 3*f* relate to constituent components of the applicator (6).
Figure 3B:
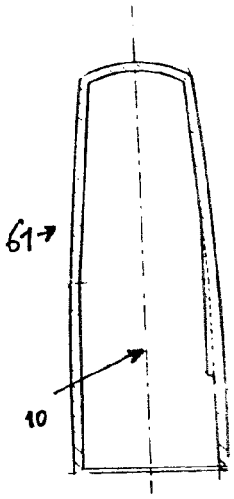
Figure 3D:
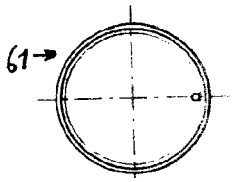
Figure 3C:
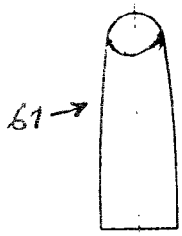
Figure 3E:
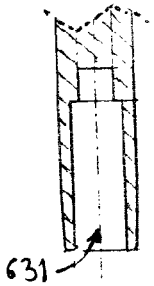
Figure 3F:
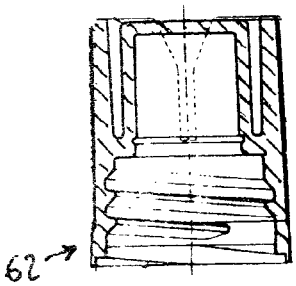
Figure 5B:
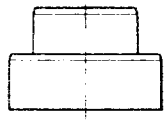
Figure 5C:
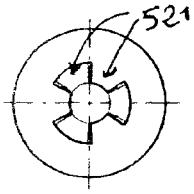
Figure 5A:
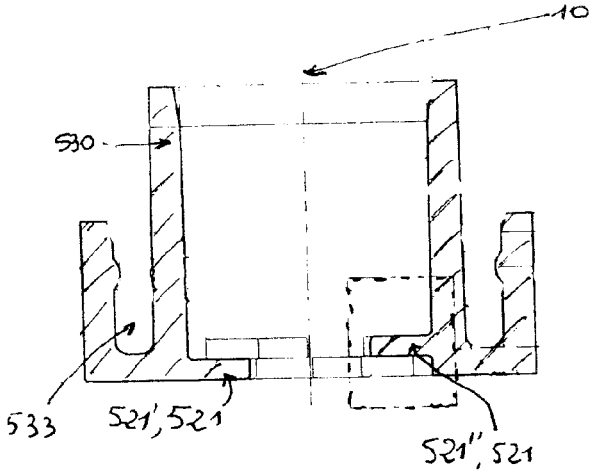
Figure 5D:
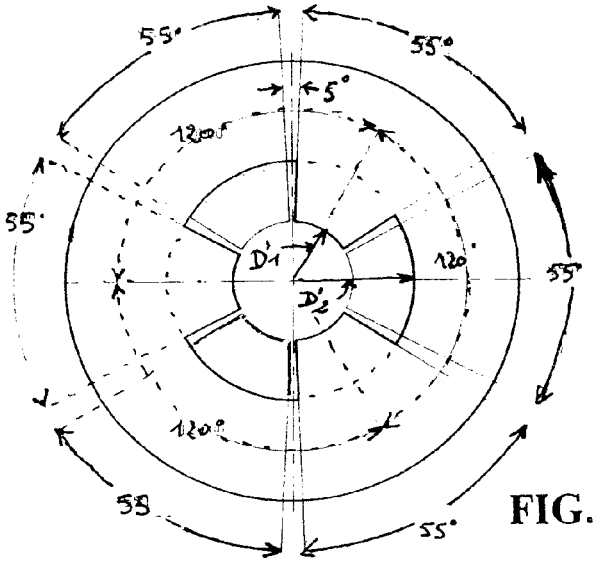
Figure 5E:
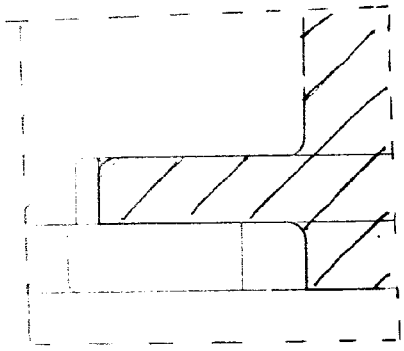

As shown in FIGS. 1*d* and 6*a* to 11*a*, all or part of the lateral part (53) of the wiper (5), which engages with the lower part (72) of the closure component (7), can be placed axially underneath the lower part (72) in such a way that the lower part (72) forms the axial stop for the lateral part (53) of the wiper (5). In this way, any axial stress exerted by the application means (64) on the wiper (5) when the applicator (6) is separated from the container (2) can be transferred to the closure component (7). The closure component (7) can be fixedly attached to the tank (3) to help prevent forward axial displacement of the wiper (5).

The lateral part (53) of the wiper (5) can be placed underneath the lower part (72) of the closure component (7), so that the lateral part (53) is typically included within an axial projection of the lower part (72) in a transverse plane perpendicular to the axial direction (10).

As shown, for example, in FIGS. 1*d*, 8*b*, 9*b* and 11*a*, the lateral part (53) of the wiper (5) and the lower part (72) of the closure component (7) can engage through the use of axial snap-on means (82). To do this, the lateral part (53) of the wiper (5) may include at least one axial projection selected from an inner axial projection (530), a central axial projection (532), and an outer axial projection (531). The inner (530) and outer (531) projections can form between them an annular groove (533) engaging with an annular projection (720) of the lower part (72), and the central axial projection (532) engaging with an annular groove (721) of the lower part (72).

Figure 9A:
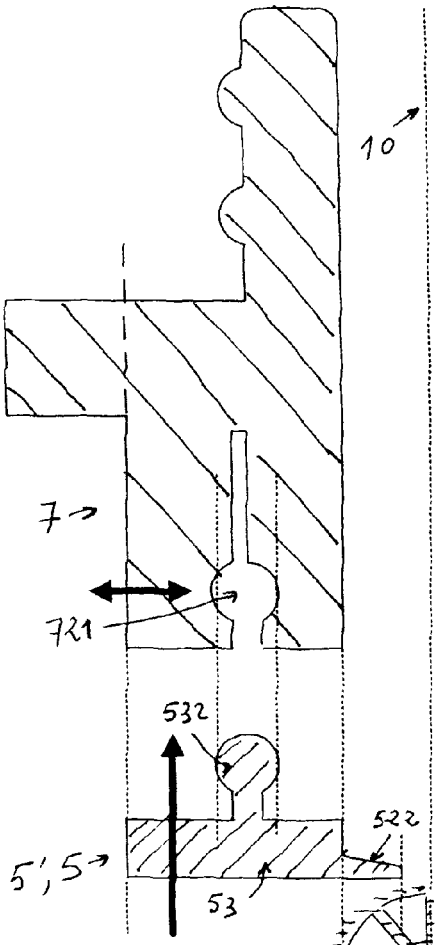
FIGS. 9*a* and 9*b* show another embodiment in which the lateral part (53) of the wiper (5) comprises a central axial projection (532) intended to engage with an annular groove (721) formed in the lower part (72) of the closure component.
Figure 9C:
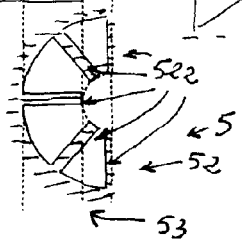
FIG. 9*c* is a partial view from underneath of the wiper (5) in FIG. 9*a*, the central part (52) of which comprises a plurality of 8 flexible axial elements (522) offset at an angle of 45° from each other.
Figure 9B:
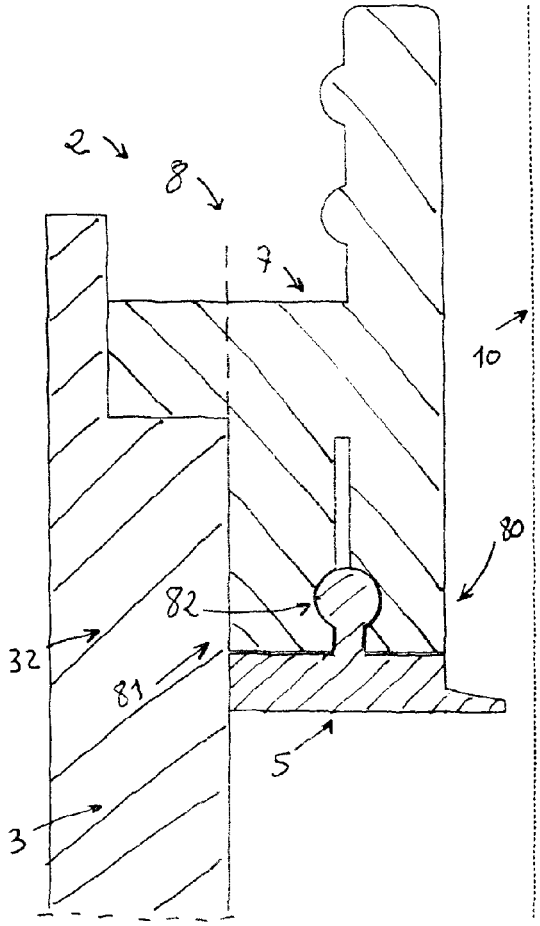
Figure 10A:
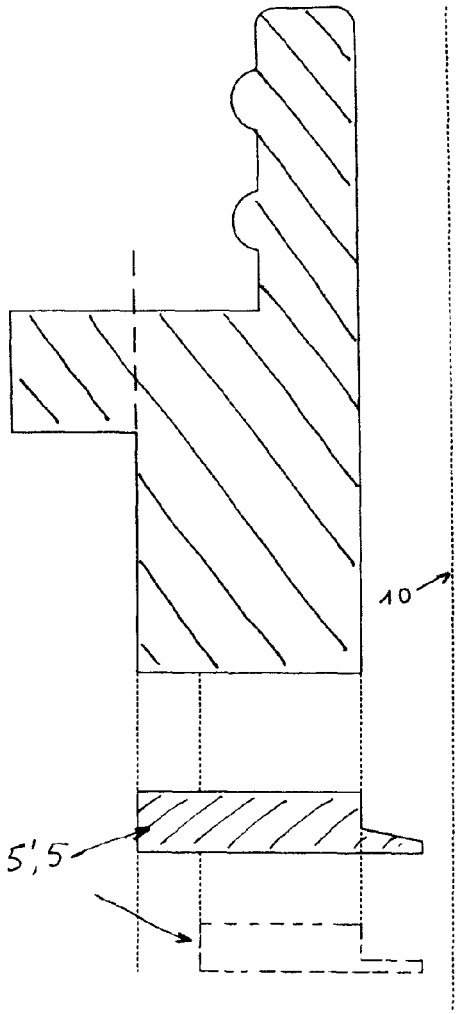
FIG. 10*a* shows the case where the wiper (5) is assembled with the closure component by bonding or over-molding. A wiper (5) of smaller outer diameter has been shown in dotted lines.
Figure 10B:
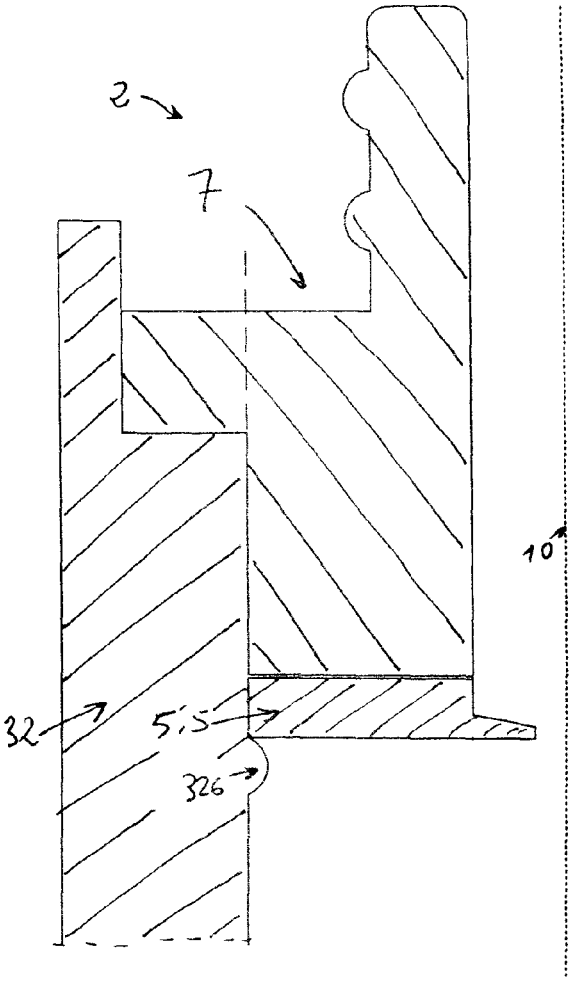
In FIG. 10*b*, the straight skirt (32) comprises a secondary shoulder (326) forming a rear axial stop for the wiper (5).

As shown, for example, in FIGS. 9*a* and 9*b*, the lateral part (53) of the wiper (5) may have a transverse cross section, in a transverse plane perpendicular to the axial direction, axially facing the lower part (72) of the closure component (7), so that the assembly component (8) has substantially cylindrical inner (80) and outer (81) axial surfaces and the transverse cross section and the axial projection are substantially facing each other along the axial direction (10).

Figure 11A:
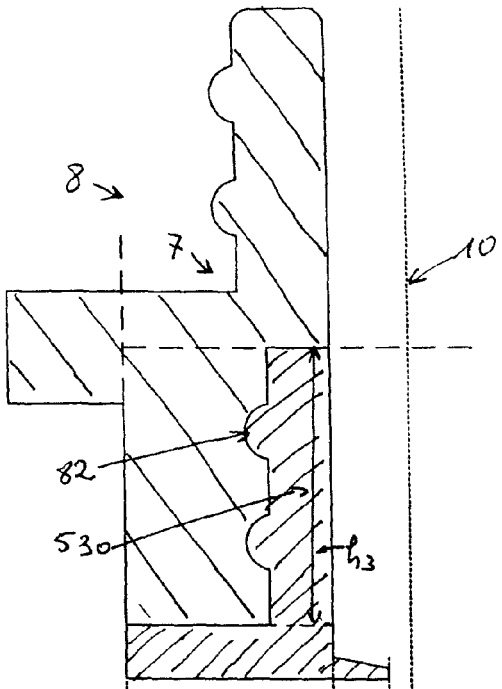
In FIG. 11*a*, the lateral part (53) of the wiper (5) comprises an inner axial projection (530) of height $h_3$.
Figure 11B:
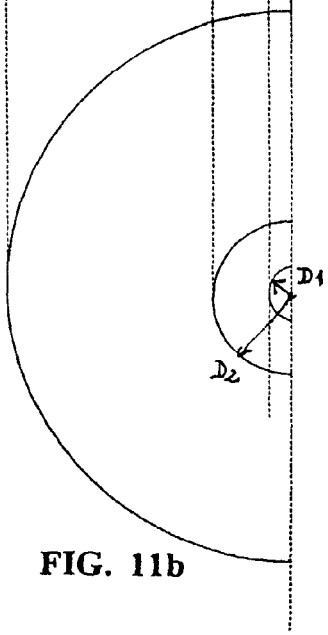
Figure 11C:
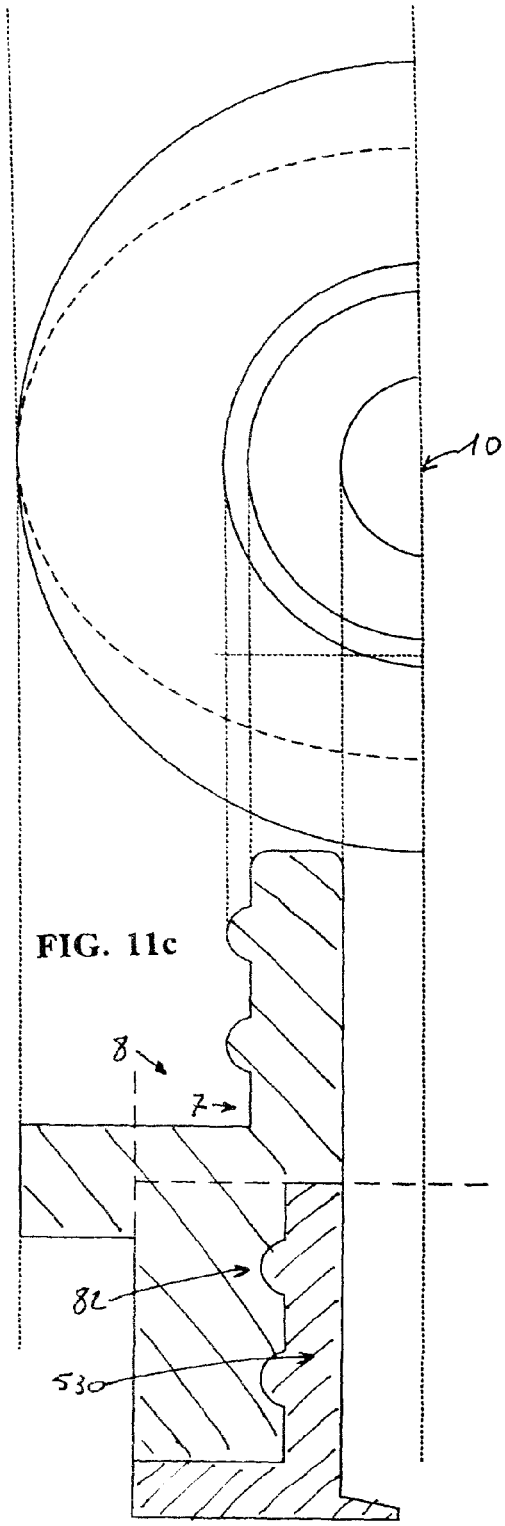
FIG. 11*c* shows a view from above of the closure component (7), shown facing the assembly component (8) in FIG. 11*a*.

As shown in FIGS. 11*a* and 11*b*, the central part (52) of the wiper (5) may form or comprise a radial ring (520) of outer diameter $D_2$ and of inner diameter $D_1$. The radial ring (520) can have a thickness that may or not be constant between its outer diameter $D_2$ and its inner diameter $D_1$. The thickness should be selected to ensure the flexibility of the radial ring (520). The outer diameter $D_2$ typically corresponds to the inner diameter of the closure component (7), and the inner diameter $D_1$ can be at least equal to the diameter of the axial wand (63), which typically is cylindrical.

As shown in FIGS. 5*a* to 5*e*, the central part (52) of the wiper (5) may form or comprise a plurality of N flexible radial elements (521) of outer diameter $D'_2$ and of inner diameter $D'_1$, with N being typically between 2 and 8. The flexible radial element (521) can form an angular sector with an angle of less than or equal to 360°/N and having a thickness which may or may not be constant between its outer diameter $D'_2$ and its inner diameter $D'_1$. The thickness should be selected to ensure the flexibility of the flexible element (521). The outer diameter $D'_2$ typically corresponds to the inner diameter of the closure component (7), and the inner diameter $D'_1$ can be at least equal to the diameter of the axial wand (63), which typically is cylindrical.

In one aspect, the number N of flexible radial elements (521) can be an even number. N/2 low elements (521') alternate angularly with N/2 high elements (521"). The low (521') and high (521") elements can be offset axially by a height at least equal to the thickness of the flexible radial element (521, 521', 521"), and typically equal to the thickness.

As shown in FIGS. 9*a* and 9*c*, the central part (52) may form or comprise a plurality of N' flexible axial elements (522) of outer diameter $D''_2$ and inner diameter $D''_1$, with N' being typically between 2 and 8. The flexible axial element (522) can have a thickness which may or may not be constant between its outer diameter $D'_2$ and its inner diameter $D'_1$. The thickness should be selected to ensure the flexibility of the flexible axial element (522). The outer diameter $D'_2$ typically corresponds to the inner diameter of the closure component (7), and the inner diameter $D'_1$ can be at least equal to the diameter of the axial wand (63).

As shown, for example, in FIGS. 2*a*, 2*c*, 6*a* and 6*b*, the straight skirt (32) of the tank (3) may comprise a thinned out part (327) with an inner channel (320) forming an inner shoulder (321), so as to form an inner rebate. The inner shoulder (321) can form an axial stop for the peripheral part (71) of the closure component (7).

Figure 6A:
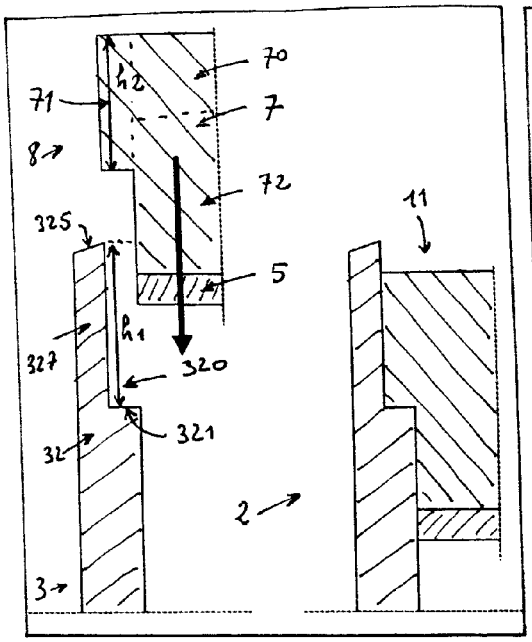
FIGS. 6*a* to 6*d* are partial left-hand axial half-sections, which are similar to each other and which show different axial assembly embodiments between the peripheral part (71, 71') of the closure component (7) and the straight skirt (32) of the tank (3).

As shown in FIGS. 1*d* and 6*a*, the inner channel (320) of the straight skirt (32) may have an axial height at least equal to that of the peripheral part (71), so that the straight skirt (32) comprises an upper wall (322) forming an axial extension of the straight skirt (32). The upper wall (322) can be located above the peripheral part (71) of the closure component (7), so that the upper wall (332) forms a (typically circular) bowl (11) with the closure component (7).

As shown in FIG. 1*c*, the outer shell (61) of the applicator (6) may have an outer diameter smaller than the diameter of the bowl (11), so that when the applicator (6) is screwed to the container (2), the outer shell (61) of the cap (60), at its lower part, is able to go back inside the bowl (11).

In each of FIGS. 6*a* to 6*d*, the left-hand part shows the assembly component (8), which comprises the closure component (7) and the wiper (5), placed above the straight skirt (32) before the axial assembly. The right-hand part shows the closure component (7) assembled with the straight skirt (32).

Figure 6C:
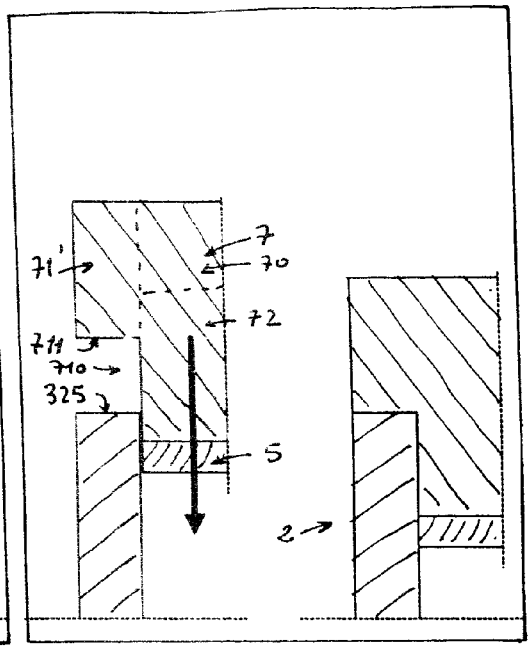
Figure 6B:
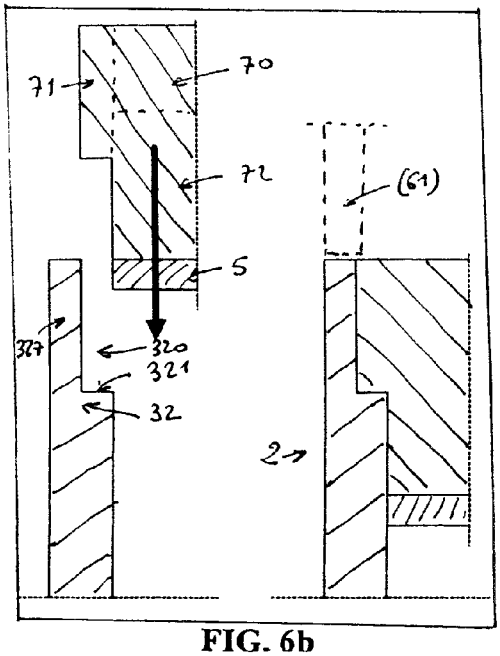

In FIGS. 6*a* and 6*b*, the straight skirt (32) has an inner channel (320) and an inner shoulder (321) against which the peripheral part (71) is stopped axially. In FIG. 6*a*, as in FIG. 1*d*, the axial height $h_1$ of the channelled out part (320) is larger than the axial height $h_2$ of the peripheral part (71), so that the container (2) forms a bowl (11) at its upper part surrounding the neck (4). Conversely, in FIG. 6*b*, the axial height $h_1$ of the channelled out part (320) is the same as the axial height $h_2$ of the peripheral part (71). In the right-hand part of FIG. 6*b*, a portion of the outer shell (61) of the cap (60) when the applicator (6) is screwed into the container (2) is shown in dotted lines.

In FIG. 6*c*, the closure component (7) or the peripheral part (71') comprises an outer channel (710) forming an outer shoulder (711) against which the straight skirt (32) at its upper end (325) can be stopped during the axial assembly.

Figure 6D:
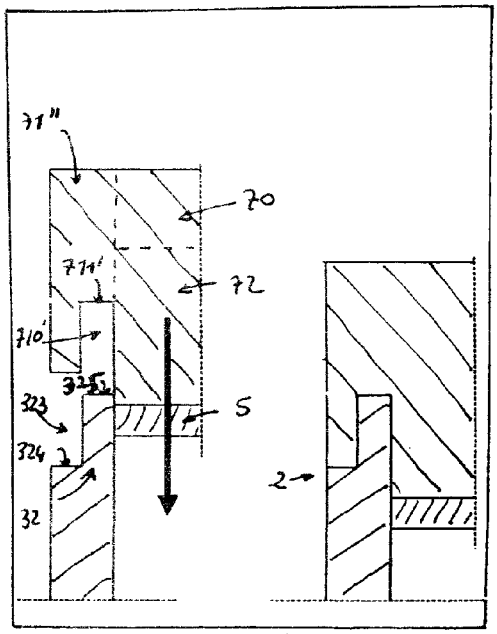

In FIG. 6*d*, the straight skirt (32) has an outer channel (323) and an outer shoulder (324) against which the peripheral part (71") can be stopped axially. Likewise, the peripheral part (71") has an inner channel (710') and a shoulder (711') against which the other end (325) of the straight skirt (32) can be stopped axially.

As shown in FIG. 6*b*, the inner channel (320) may have an axial height equal to that of the peripheral part (71), so that the peripheral part (71) of the closure component (7) has an upper edge aligned with the straight skirt (32) at its upper end (325).

As shown in FIG. 6*d*, the straight skirt (32) may comprise a thinned out part with an outer channel (323) forming an outer shoulder (324). The thinned out part, at its upper end (325) or the outer shoulder (324), can form an axial stop for the peripheral part (71') of the closure component (7).

As shown in FIG. 6*c*, the closure component (7) or the peripheral part (71) may have an outer channel (710) forming an outer shoulder (711) for the straight skirt (32) at its upper end (325).

As shown in the right-hand part of FIG. 6*b*, the outer shell (61) of the cap (60) may have an outer cross-section which is in the axial extension of that of the straight skirt (32) of the tank (3) when the applicator (6) is screwed into the container (2).

Figure 7A:
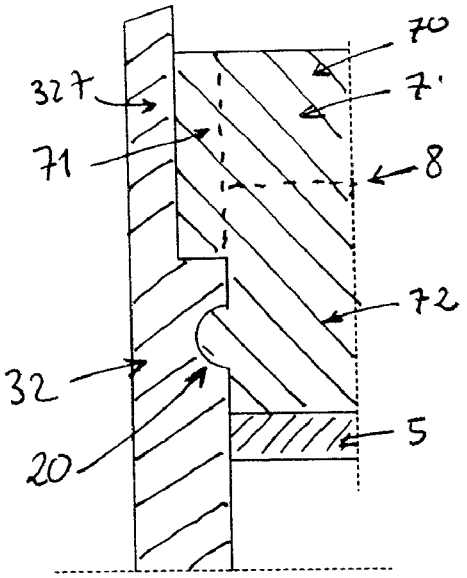
FIGS. 7*a* to 7*d* show different means (20) for axially snapping on the assembly component (8) comprising the closure component (7) and the tank (3).

In FIG. 7*a*, the axial snap-on means (20) comprise the engagement of an annular male part, in a semi-circle, carried on the outer surface of the lower part (72) of the closure component (7) and a corresponding female part carried on the inner surface of the straight skirt (32).

Figure 7B:
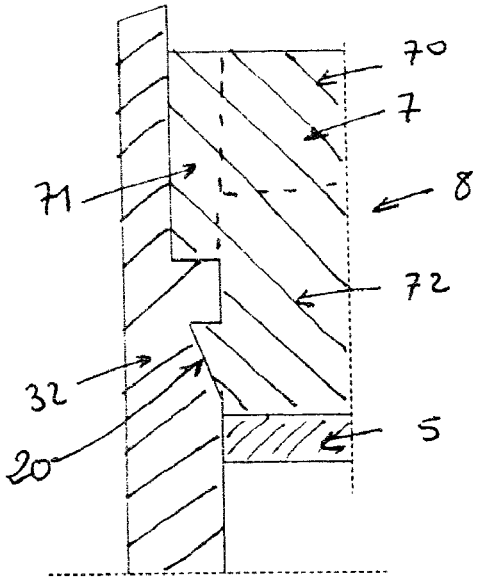
Figure 7C:
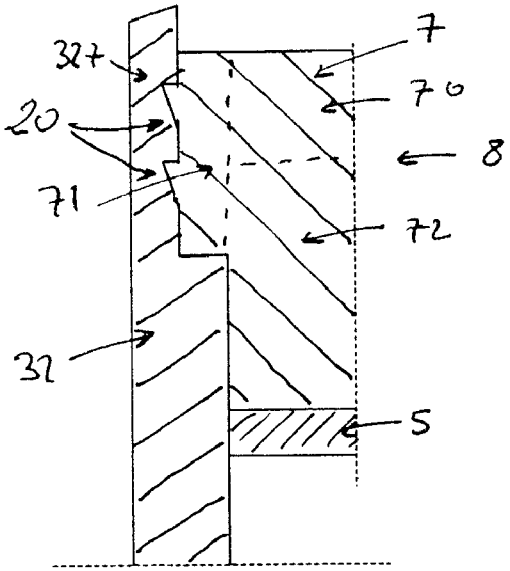

In FIG. 7*b*, similar to FIG. 7*a*, the male and female parts have a right angle triangle-shaped cross-section. In FIG. 7*c*, similar to FIG. 7*b*, the male and female parts are two in number and are carried by the peripheral part (71) and by the thinned out part (327) of the straight skirt (32), respectively.

Figure 7D:
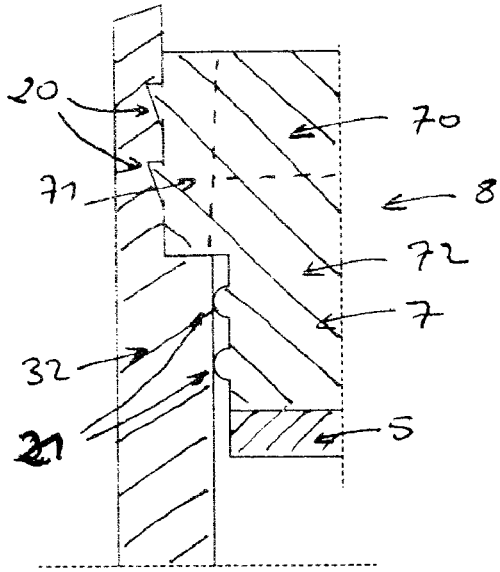

In FIG. 7*d*, similar to FIG. 7*c*, the lower part (72) comprises a plurality of circular ribs as shown in FIG. 4*f*, which engage with the straight skirt (23) to form a sealing means (21).

Figure 8A:
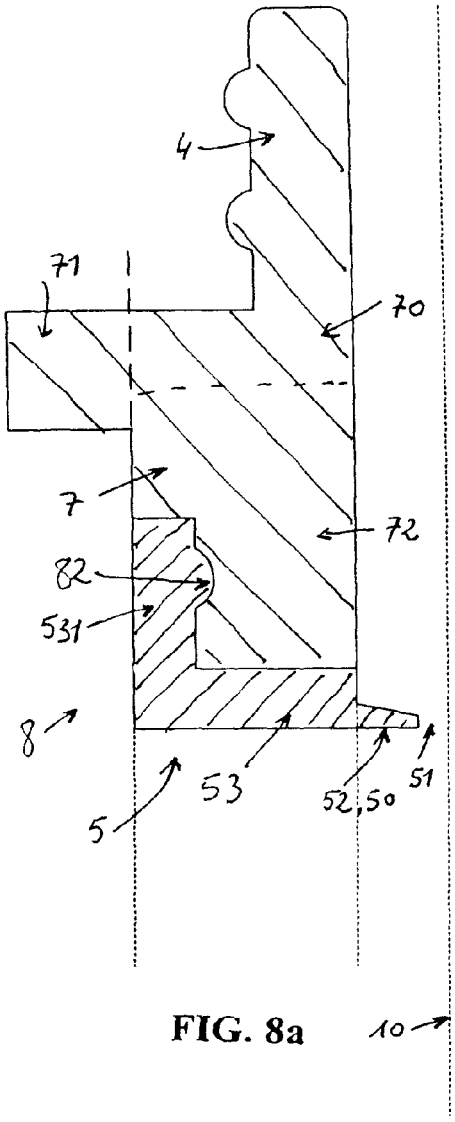
Figure 8B:
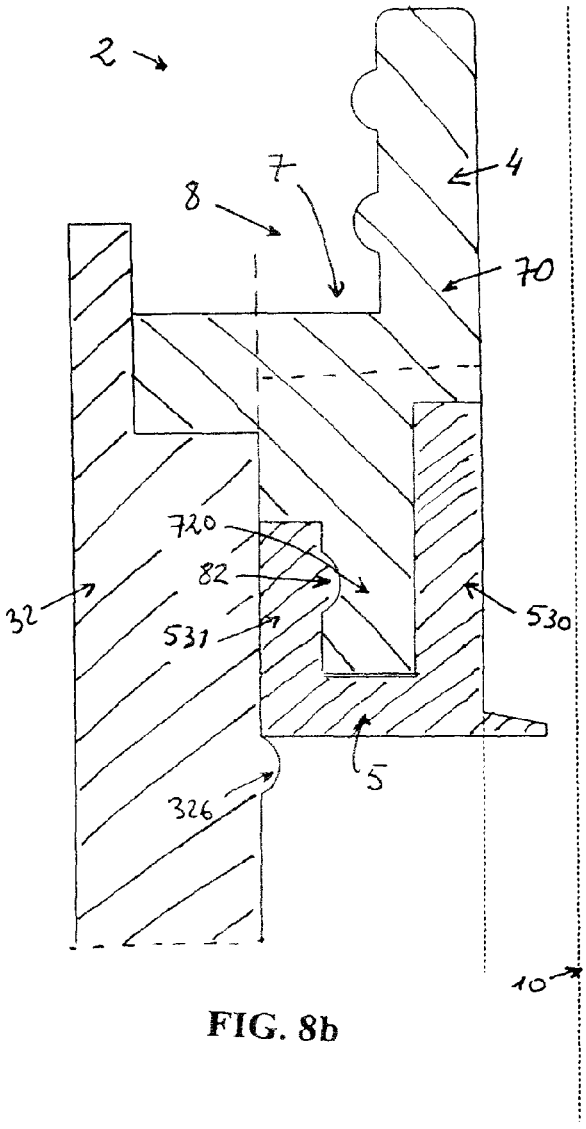
In FIG. 8*b*, the lateral part (53) of the wiper (5) additionally comprises an inner axial projection (530) as in the example shown in FIG. 5*a*.

As shown in FIG. 8*b*, the straight skirt (32) may comprise a secondary shoulder (326) forming a peripheral axial stop for the lateral part (53) of the wiper (5, 5').

As shown in FIGS. 1*d* and 12*a* to 12*c*, the longitudinal tank (3) can be a molded tank (3'), comprising a bottom (34), typically formed by a small bottle.

In FIG. 9*a*, the closure component (7) and wiper (5) are placed axially facing prior to being axially snapped on. FIG. 9*b* shows these two snapped-on components, with the assembly component (8) thus formed assembled with the tank (3) to form the container (2).

Figure 13A:
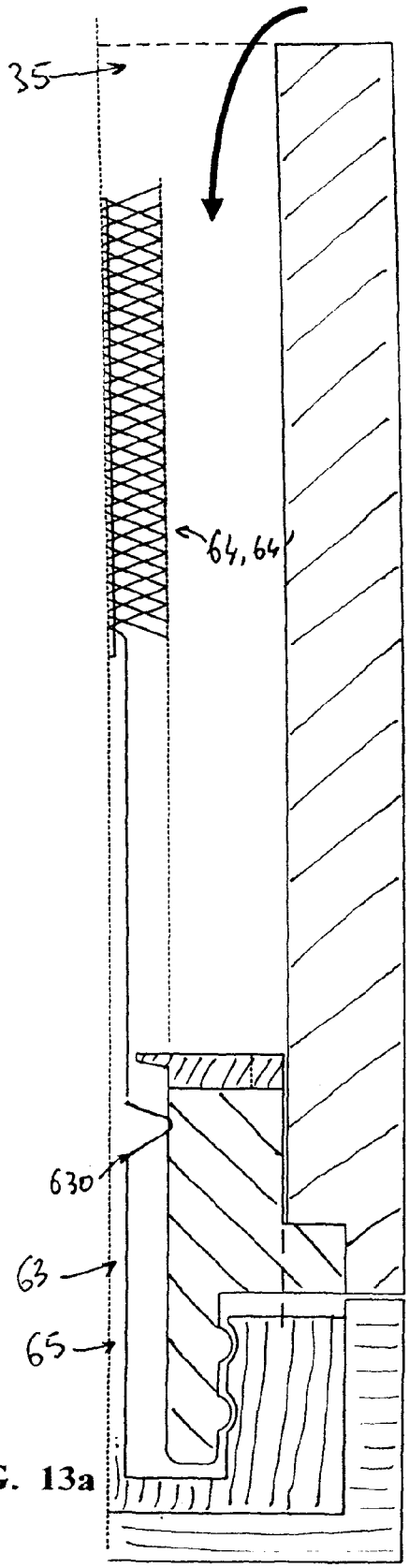
FIGS. 13*a* and 13*b* are left-hand axial half-sections which show an operation to fill the tank (3) in the situation where the tank (3) is a tube body (3") fitted with an open bottom (35), as shown in FIG. 13*a*, whereas in FIG. 13*b*, the bottom is a bottom (36) welded after filling the tube body (3") through the open bottom (35).
Figure 13B:
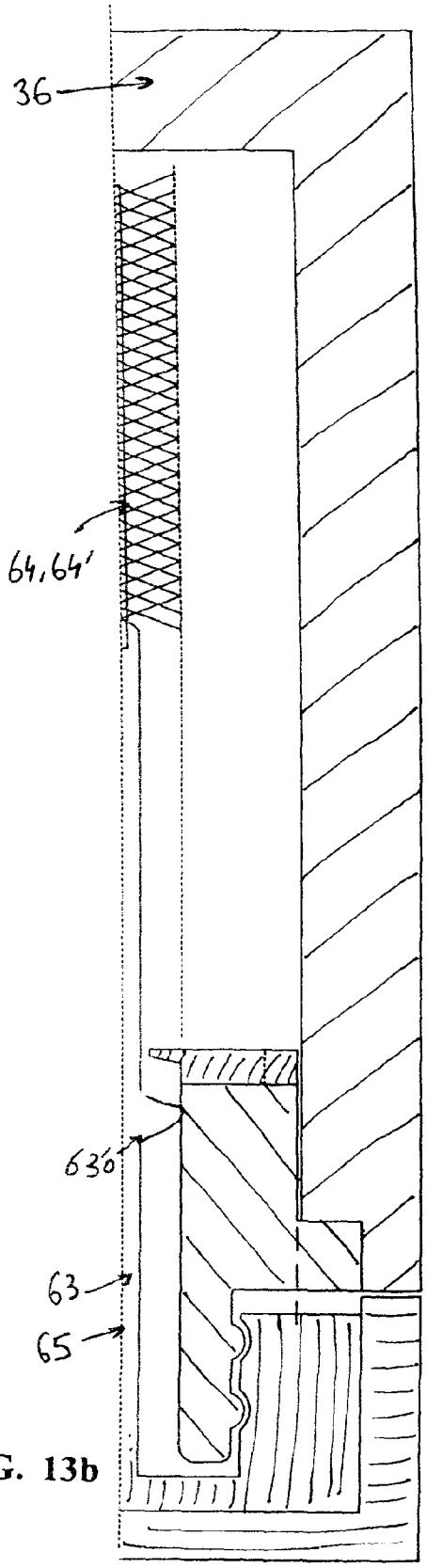

As shown in FIGS. 13*a* and 13*b*, the longitudinal tank (3) can be a tube body (3") that has an open bottom (35) for the purpose of filling it with the product.

The axial assembly can provide a sealed engagement between the peripheral part (71) of the closure component (7) and the straight skirt (32) of the tank (3). The sealed engagement can be created by axially snapping (20), welding, for example by application of ultrasound, bonding, or any combination thereof. For example, in the embodiment shown in FIGS. 1*d*, 7*a* to 7*d*, the sealed engagement is obtained by axial snap-on (20).

Typically, the wiper (5, 5') may be formed of an elastomeric or rubbery plastic material. As shown, for example, in FIGS. 1*d*, 5*a*, 11*a*, the wiper (5, 5') may comprise the inner axial projection (530). The inner axial projection (530) can have an inner diameter equal to but typically is smaller than the inner diameter of the closure component (7).

Figure 14:
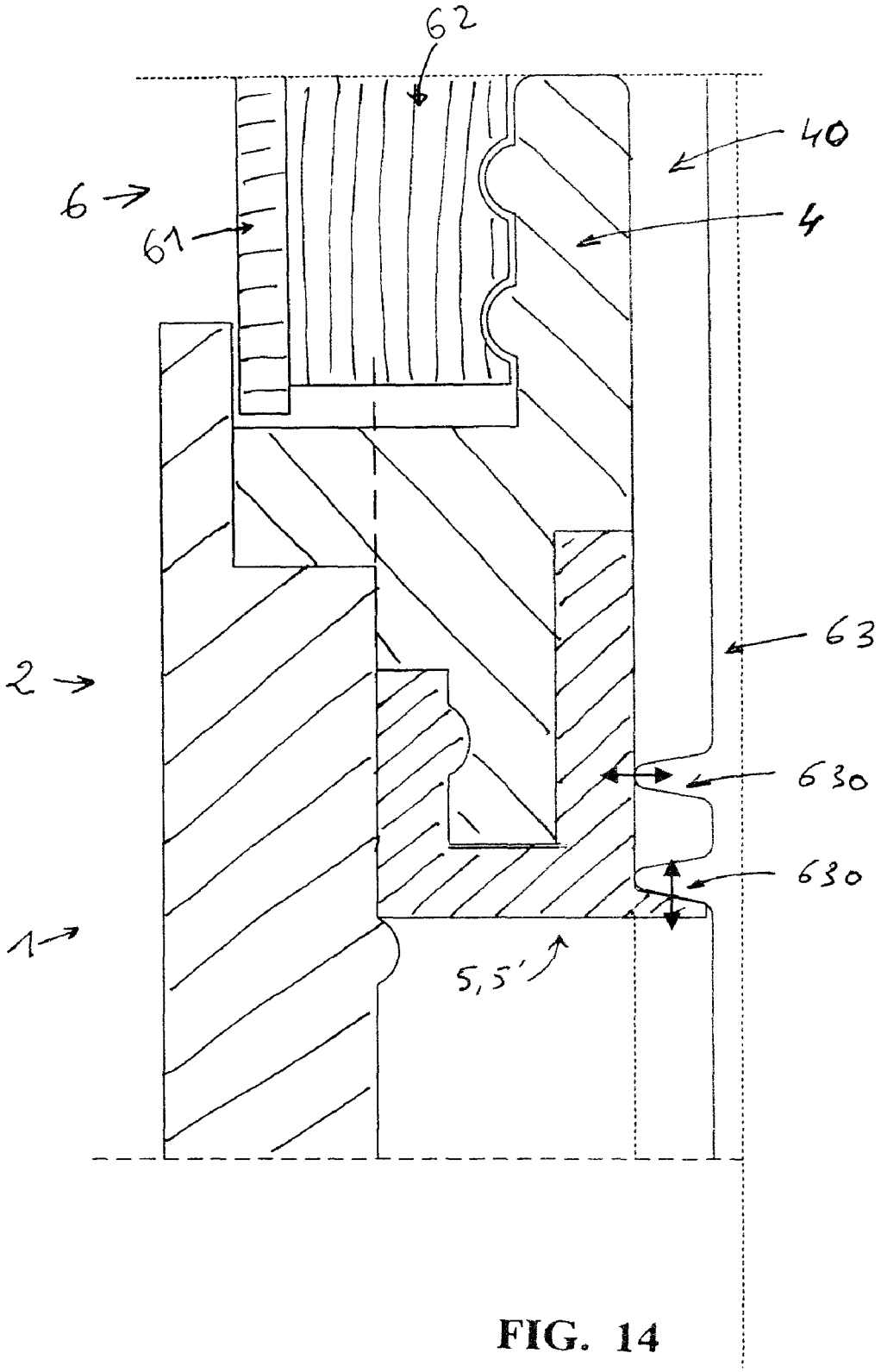
FIG. 14 is a partial axial half-section which shows the sealed engagement of the annular radial projections (630, 630') with the wiper (5, 5') when the applicator dispenser (1) is closed, the applicator (6) being screwed into the neck (4) of the container (2).

As shown particularly in FIGS. 1*e* and 14, the axial wand (63) of the applicator (6) may have at least one annular radial projection (630, 630') able to engage in a sealed way with the wiper (5, 5'), the inner axial projection (530) of the wiper, and/or the central part (52) of the wiper (5).

As shown in FIG. 14, it is thereby possible to have two distinct cumulative means to provide the sealed closure of the orifice (40) of the neck (4). The lower annular radial projection (630) is typically in axial support against the central part (52) of the wiper (5), with its periphery also engaging with the inner axial projection (530) of the lateral part (53) of the wiper (5). The upper annular radial projection (630') can engage with the inner axial projection (530). Alternatively, there may be only one annular radial projection, for example either lower (630) or upper (630') annular radial projection.

Figures 12A, 12B, 12C:
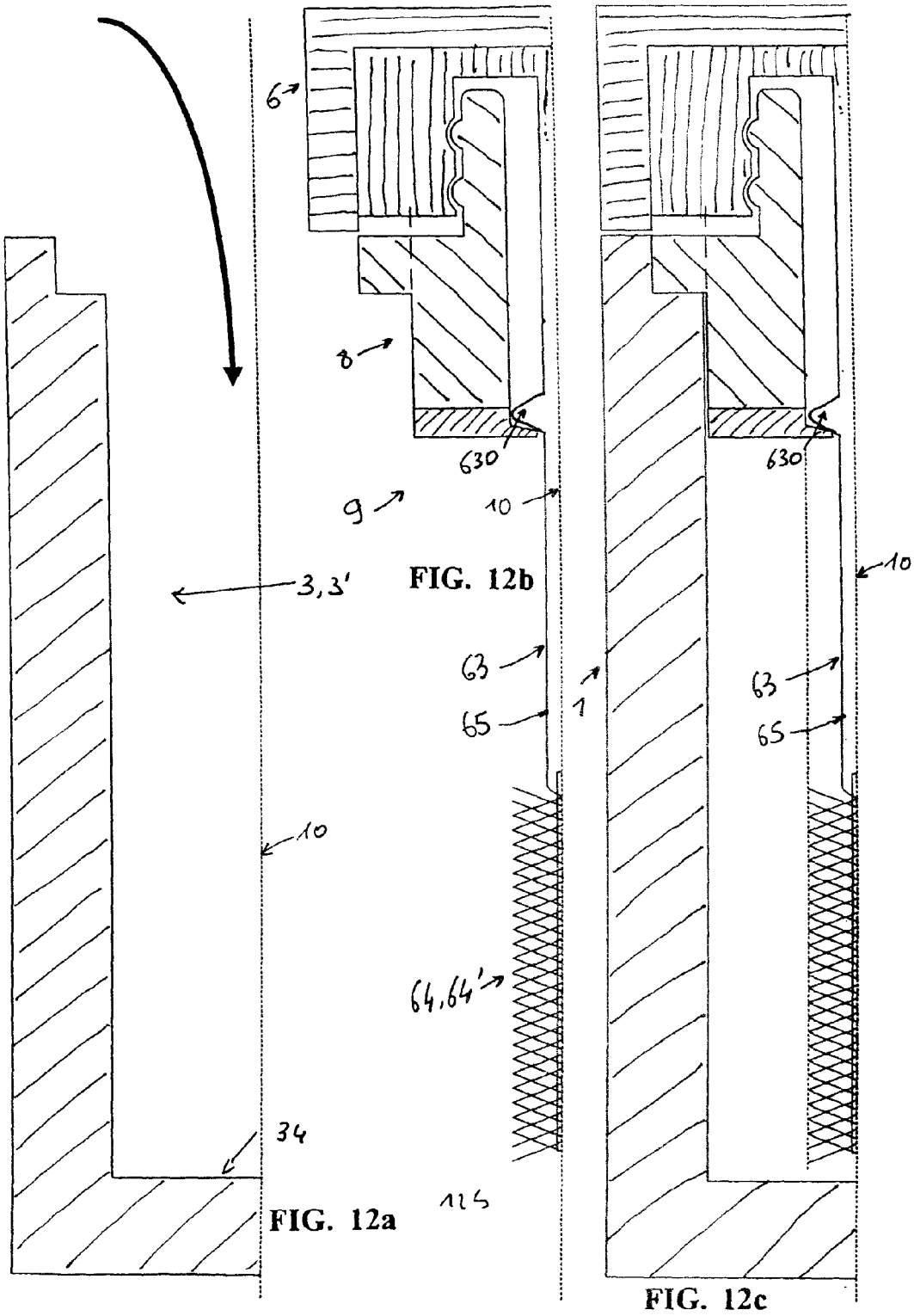
FIGS. 12*a* to 12*c* show left-hand axial half-sections which show an operation to fill the tank (3) in the situation where the tank (3) is a molded tank (3') fitted with a bottom (34).

As shown in FIGS. 12*b* and 12*c*, the application means (64) of the applicator (6) may comprise, for example, a brush (64') having as the stock a pin or metal wire twisted into a plurality of coils, anchoring a plurality of hairs. The invention is not limited to any particular type of applicator.

As shown in FIG. 1*e*, the application means (64) of the applicator (6) may comprise a component made out of a molded plastic material (64") fitted with hollow parts to allow some of the product to be taken out for application thereof.

EMBODIMENT EXAMPLES

The applicator dispenser (1) was made in accordance with FIGS. 1*a* to 5*e*. To do this, the following components were made by injection molding. As regards the components of the container (2), the tank (3) was made of PP, the closure component (7) was made of POM or ABS, and the wiper (5, 5') was made of Santoprene® brand elastomer or Nitrile Butadiene Rubber (NBR). As regards the application components (6), the outer shell (61) was made of PP or ABS, the axial wand (63) and the insert (62) were made of POM, and the application means (64") was made molded out of LDPE or Hytrel® or Desmopan® brand low module modified PP.

The components forming the applicator (6), and the components (5) and (7) forming the assembly component (8), were assembled. Then, two types of unit were formed: a so-called traditional unit comprising the applicator (6) and the container (2) formed by assembling the assembly component (8) with the tank (3). This traditional assembly is adapted for traditional product filling. A second unit included the tank (3) and the closure unit (9) formed by screwing the applicator (6) to the assembly component (8). The second unit allows faster filling of the tank (3).

These alternatives relate in particular to the method of sealed engagement between the tank (3) and the closure component (7) or the assembly component (8), as can be seen in FIGS. 6*a* to 7*d*. These alternatives also relate to the method of assembling the closure component (7) and the lateral part (53) of the wiper (5) so as to form the assembly component (8), as can be seen in FIGS. 8*a* to 11*c*. These alternatives further relate to the central part (52) of the wiper (5) as shown in FIGS. 5*a* to 5*e*, 9*a*, 9*c* and 11*b*. These alternatives relate to the type of application means (64, 64', 64") as shown in FIGS. 1*e*, 12*b* to 13*b*. These alternatives also relate to the sealed engagement between the applicator (6) and the assembly component (8) as shown in FIGS. 12*b* to 14, through the annular radial projections (630, 630'). In addition, these alternatives relate to the engagement of the cap (60) and the axial wand (63) of the applicator (6): either an insert (62) is used as in FIG. 1*e*, or the insert and the axial wand (63) can form a single molded component (65) as in FIGS. 12*a* to 13*b*.

In addition to resolving problems associated with conventional applicator dispensers such as those relating to the wiper, the applicator dispenser (1) can be constructed in a large number of different embodiments, only some of which have been shown in the Figures. As a result, the applicator dispenser (1) can be customized or adapted to meet the requirements of each customer. Moreover, the applicator dispenser (1) provides several advantageous technical contributions, both as regards the neck seal, and the possibility of faster filling and/or using different types of tanks.

Components of the applicator dispenser (1) can be manufactured by usual means of injection molding and can be assembled by axial snapping. Together this can provide a method of assembly that is relatively easy to automate.

LIST OF REFERENCE NUMBERS

| | |
|---|---|
| Applicator Dispenser | 1 |
| Axial Direction | 10 |
| Bowl formed by 322 and 7 | 11 |
| Container | 2 |
| Snap-on means for 7, 8 and 3 | 20 |
| Sealing means between 7, 8 and 3 | 21 |
| Tank | 3 |
| Molded Tank | 3' |
| Tube Body | 3" |
| Lateral Wall | 30 |
| Cavity | 31 |
| Straight Skirt | 32 |
| Inner Channel | 320 |
| Inner Shoulder | 321 |
| Upper Wall | 322 |
| Outer Channel | 323 |
| Outer Shoulder | 324 |
| Upper End of 32 | 325 |
| Secondary Shoulder | 326 |
| Thinned out Part | 327 |
| Upper Opening | 33 |
| Bottom | 34 |
| Open Bottom | 35 |
| Neck | 4 |
| Neck Orifice | 40 |
| Wiper | 5 |
| Distinct Molded Component | 5' |
| Swaged Part | 50 |
| Central Orifice | 51 |
| Central Part | 52 |
| Radial Ring | 520 |
| Flexible Radial Element | 521 |
| Flexible Low Element | 521' |
| Flexible High Element | 521" |
| Flexible Axial Element | 522 |
| Lateral Part | 53 |
| Inner Axial Projection | 530 |
| Outer Axial Projection | 531 |
| Central Axial Projection | 532 |
| Annular Groove between 530 and 531 | 533 |
| Applicator | 6 |
| Cap | 60 |
| Outer Shell | 61 |

-continued

| LIST OF REFERENCE NUMBERS | |
|---|---|
| Insert | 62 |
| Axial Wand | 63 |
| Radial Annular Projection | 630,630' |
| Means of anchoring 64 | 631 |
| Head for Assembly with the Insert 62 | 632 |
| Application Means | 64 |
| Brush | 64' |
| Molded Application Means | 64" |
| Component for closing 33 | 7 |
| Upper Part forming 4 | 70 |
| Peripheral Part | 71,71' |
| Outer Channel | 710 |
| Outer Shoulder | 711 |
| Lower Part | 72 |
| Annular Groove (engages with 533) | 720 |
| Annular Groove (engages with 532) | 721 |
| Assembly Component = 5 + 7 | 8 |
| Inner Axial Surface | 80 |
| Outer Axial Surface | 81 |
| Snap-on Means | 82 |
| Unit for closing 3 (=5 + 6 + 7) | 9 |

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention and described and claimed herein.

We claim:

1. An applicator dispenser for a cosmetic product, the applicator dispenser having an axial direction and comprising:

a) a container comprising a neck threaded on the outside and a longitudinal tank fitted with a lateral wall and forming a cavity for packaging said cosmetic product, said neck being integral with a wiper of an application means comprising a swaged wiping part delimiting a central orifice;

b) an applicator of said cosmetic product comprising a cap forming a means of gripping said applicator, said cap comprising an outer shell and an insert threaded internally so as to engage with said neck by screwing so as to provide a sealed closure of said container, an axial wand fixedly attached by its upper end to said insert and by its lower end to said application means, said application means being physically immersed in said product when said cap of said applicator is screwed onto said neck;

wherein said lateral wall of said tank forms or comprises at its upper part a straight skirt, open at its upper end;

wherein said container comprises a closure component for closing said upper opening integral with said tank, said closure component forming a molded component distinct from said tank and comprising an upper part forming said neck, a peripheral part engaging in a sealed way with said straight skirt of said tank via an axial assembly, and a lower part engaging with said wiper forming a forward axial stop for said wiper;

wherein said straight skirt comprises a thinned out part with an inner channel forming an inner shoulder, so as to form an inner rebate, said inner shoulder forming an axial stop for said peripheral part of said closure component wherein said inner channel of said straight skirt has an axial height at least equal to that of said peripheral part, wherein said straight skirt comprises an upper wall forming an axial extension of said straight skirt, said upper wall being located above said peripheral part of said closure component, and wherein said upper wall forms a bowl with said closure component; and wherein said wiper forms a molded component distinct from said closure component, said wiper comprising a central part forming said swaged part and a lateral part engaging with said lower part of said closure component by a secondary assembly, so as to form an assembly component.

2. A dispenser according to claim 1 wherein in said lateral wall of said tank, said straight skirt, open at its upper end, has an upper opening of transverse cross section of between about 50 and about 150 $mm^2$.

3. A dispenser according to claim 1 wherein all or part of said lateral part of said wiper, which engages with said lower part of said closure component, is placed axially underneath said lower part, in such a way that said lower part forms said axial stop for said lateral part of said wiper, so that any axial stress exerted by said application means on said wiper when said applicator is separated from said container is transferred to said closure component, wherein said closure component is fixedly attached to said tank to prevent forward axial displacement of said wiper.

4. A dispenser according to claim 1 wherein the whole of said lateral part of said wiper is placed underneath said lower part of said closure component, in such a way that said lateral part is included within an axial projection of said lower part in a transverse plane perpendicular to said axial direction.

5. A dispenser according to claim 4 wherein said lateral part of said wiper comprises a transverse cross section, in a transverse plane perpendicular to said axial direction, axially facing said lower part of said closure component, so that said assembly component has substantially cylindrical inner and outer axial surfaces and in such a way that said transverse cross section and said axial projection are substantially facing each other along said axial direction.

6. A dispenser according to claim 1 wherein said lateral part of said wiper comprises at least one axial projection selected from the group consisting of an inner axial projection, a central axial projection, and an outer axial projection, wherein said inner and outer projections form between them an annular groove engaging with an annular groove of said lower part, said central axial projection engaging with an annular groove of said lower part.

7. A dispenser according to claim 1 wherein said central part of said wiper forms or comprises a radial ring having an outer diameter and an inner diameter, said radial ring having a thickness that may or may not be constant between the outer diameter and the inner diameter, wherein the thickness is selected to ensure the flexibility of said radial ring and the inner diameter is equal to or greater than the diameter of said axial wand.

8. A dispenser according to claim 1 wherein the outer shell of said applicator has an outer diameter smaller than the diameter of said bowl, whereby when said applicator is screwed into said container, said outer shell of said cap, at its lower part, is able to go back inside said bowl.

* * * * *